US011506393B2

(12) United States Patent
Cowan

(10) Patent No.: US 11,506,393 B2
(45) Date of Patent: Nov. 22, 2022

(54) GAS COOKING APPLIANCE WITH GAS BURNER STATE INDICATIONS

(71) Applicant: Midea Group Co., Ltd., Foshan (CN)

(72) Inventor: Richard W. Cowan, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 79 days.

(21) Appl. No.: 17/178,114

(22) Filed: Feb. 17, 2021

(65) Prior Publication Data

US 2022/0260258 A1 Aug. 18, 2022

(51) Int. Cl.

| | |
|---|---|
| ***F24C 3/12*** | (2006.01) |
| ***F23N 1/00*** | (2006.01) |
| ***F24C 3/10*** | (2006.01) |

(52) U.S. Cl.

CPC ..... *F24C 3/126* (2013.01); *F23N 1/005* (2013.01); *F24C 3/124* (2013.01); *F23N 2229/00* (2020.01); *F23N 2235/16* (2020.01); *F24C 3/103* (2013.01)

(58) Field of Classification Search

CPC ..... F24C 3/124; F24C 3/126; F23N 1/005
USPC ..... 431/27, 70; 126/39 E
See application file for complete search history.

(56) References Cited

U.S. PATENT DOCUMENTS

| | | | | |
|---|---|---|---|---|
| 6,280,180 | B1 | 8/2001 | Fredin-Garcia-Jurado et al. | |
| 6,729,873 | B2 | 5/2004 | Neufield et al. | |
| 7,628,607 | B2 | 12/2009 | Gama et al. | |
| 7,926,964 | B2 | 4/2011 | Claprood | |
| 9,605,852 | B2 | 3/2017 | Porraro | |
| 10,022,014 | B2 | 7/2018 | Mateos Martin et al. | |
| 2011/0086319 | A1 | 4/2011 | Chodacki et al. | |
| 2013/0260320 | A1 | 10/2013 | Townsend | |
| 2016/0178214 | A1* | 6/2016 | Petersen | F24C 3/126 126/41 R |
| 2016/0348916 | A1* | 12/2016 | French | F16K 37/0025 |

FOREIGN PATENT DOCUMENTS

| | | | |
|---|---|---|---|
| EP | 0859192 | A1 | 8/1998 |
| EP | 1818618 | A2 | 8/2007 |

OTHER PUBLICATIONS

Fisher & Paykel, Fisher & Paykel Izona Platinum, 36 inch Gas CookSurface with 3 Sealed Burners, Audio/Visual Interface, Electronic Flame Settings and Ceramic Glass Cooktop: Standard Depth, AJ Madison Inc., Retrieved from: https://www.ajmadison.com/cgi-bin/ajmadison/CG363MLDNGB1.html, dated 2020.

* cited by examiner

*Primary Examiner* — Vivek K Shirsat
(74) *Attorney, Agent, or Firm* — Middleton Reutlinger

(57) ABSTRACT

A cooking appliance and method may generate one or more audible and/or visual indications to a user of various gas burner states during the operation of a gas burner, including, for example, states that are associated with different types of ignition operations, such as initial ignition operations, programmed re-ignition operations and/or flame loss re-ignition operations and/or states that are associated with ignition operations, normal operating conditions, and/or failure conditions.

20 Claims, 6 Drawing Sheets

GAS COOKING APPLIANCE WITH GAS BURNER STATE INDICATIONS

BACKGROUND

Cooking appliances such as cooktops, ovens and ranges may be powered by various types of burners or cooking elements, with electrical heating elements and gas burners being among the most common. In particular, gas burners generally use as an energy source a combustible gas such as natural gas or liquified petroleum (LP) gas (also referred to as propane), and generate heat by combusting and burning the gas. The output levels of gas burners are generally controlled by valves, which regulate gas flow to the gas burners, and which are coupled either mechanically or electronically to associated user controls, e.g., knobs, sliders, or the like. Gas burners also generally require some manner of igniting the burners. For gas cooktop burners, for example, spark igniters are commonly used, while for gas oven burners, hot surface igniters are also commonly used. In addition, some cooking appliances incorporate automatic ignition modules that include flame sensors and that are capable of automatically re-igniting a gas burner in response to a detected flame loss by a flame sensor.

With many manual gas cooktops, for example, a control knob is typically mechanically coupled to a gas valve, and a switch is used to activate a spark igniter when the control knob is in a particular range of rotational positions or when the control knob is pressed inwardly. A user is generally required to visually confirm that a flame has been attained prior to turning the control knob to an operating position and deactivating the spark igniter. If a flame is not attained, however, or if a flame loss has occurred, a user is generally not alerted, and a risk exists that a gas valve may remain open despite no combustion is occurring.

With digital gas cooktops, a user control is usually electronically coupled to an electromechanical gas valve, and an automatic ignition system is used to ignite, and if necessary, attempt to re-ignite a gas burner and control the output of the gas burner according to the user control. Moreover, when re-ignition is unsuccessful, the gas valve may be automatically shut off to prevent further output of gas from the gas valve. Nonetheless, a user may be unaware that flame loss has occurred or that re-ignition has been attempted, which could signify a need to service the cooking appliance or otherwise address the root cause of the flame loss.

SUMMARY

The herein-described embodiments address these and other problems associated with the art by utilizing a control circuit in a gas cooking appliance to generate one or more audible and/or visual indications to a user of a plurality of different gas burner states during the operation of a gas burner. In some instances, for example, the gas burner states may include states that are associated with different types of ignition operations, such as initial ignition operations, programmed re-ignition operations and/or flame loss re-ignition operations. Further, in some instances, the gas burner states may include states that are associated with at least ignition operations, normal operating conditions, and failure conditions.

Therefore, consistent with one aspect of the invention, a cooking appliance may include a cooktop including a gas burner, an igniter disposed adjacent to the gas burner to ignite the gas burner, a flame detector positioned to sense a flame emitted by the gas burner, an electromechanical gas valve configured to regulate gas flow to the gas burner, a burner control electronically coupled to the gas valve to vary the gas flow to the gas burner, a visual indicator device positioned proximate the burner control, and a control circuit coupled to the indicator, the igniter, the electromechanical gas valve and the flame detector and configured to control the electromechanical valve to regulate gas flow to the gas burner and activate the igniter when gas is flowing to the gas burner, the control circuit further configured to detect a flame loss using the flame detector and control the visual indicator device to distinguish between first, second, third, fourth, and fifth states of the gas burner. When the gas burner is in the first state, the control circuit controls the visual indicator device to indicate that the gas burner is performing an initial ignition operation, when the gas burner is in the second state, the control circuit controls the visual indicator device to indicate that the gas burner is in a normal operating condition, when the gas burner is in the third state, the control circuit controls the visual indicator device to indicate that the gas burner is performing a flame loss re-ignition operation, when the gas burner is in the fourth state, the control circuit controls the visual indicator device to indicate that the gas burner is performing a program re-ignition operation, and when the gas burner is in the fifth state, the control circuit controls the visual indicator device to indicate that the gas burner has a failure condition due to an inability to ignite the gas burner after attempting an initial ignition, flame loss re-ignition or program re-ignition operation.

Consistent with another aspect of the invention, a cooking appliance may include a gas burner, an igniter disposed adjacent to the gas burner to ignite the gas burner, a gas valve configured to regulate gas flow to the gas burner, a burner control coupled to the gas valve to vary the gas flow to the gas burner, and a control circuit coupled to the igniter and configured to activate the igniter when gas is flowing to the gas burner. The control circuit is further configured to generate a first indication to a user in response to performing a first ignition operation of a first ignition type and to generate a second indication to the user in response to performing a second ignition operation of a second ignition type, and the first and second indications are different from one another to distinguish between the first and second ignition types.

In some embodiments, the first ignition type is an initial ignition type and the second ignition type is a re-ignition ignition type. Also, in some embodiments, the second ignition type is a flame loss re-ignition ignition type, the control circuit is further configured to generate a third indication to the user in response to performing a third ignition operation of a third ignition type, and the third ignition type is a program re-ignition ignition type. Further, in some embodiments, the first ignition type is a flame loss re-ignition ignition type and the second ignition type is a program re-ignition ignition type.

In some embodiments, the control circuit is configured to generate each of the first and second indications by generating audible indications. In addition, in some embodiments, the control circuit is configured to generate each of the first and second indications by generating visual indications. In some embodiments, the burner control includes a rotary control actuator and a visual indicator device, and the control circuit is configured to generate each of the first and second indications using the visual indicator device. In addition, in some embodiments, the visual indicator device is a light ring that circumscribes the rotary control actuator.

Moreover, in some embodiments, the control circuit is configured to generate the first indication by illuminating the visual indicator device with a first illumination scheme, and to generate the second indication by illuminating the visual indicator device with a second illumination scheme. In some embodiments, the control circuit is further configured to illuminate the visual indicator device with a third illumination scheme when the burner is in a normal operating condition. Moreover, in some embodiments, the control circuit is further configured to illuminate the visual indicator device with a fourth illumination scheme when the gas burner has a failure condition.

Some embodiments may also include a flame detector positioned to sense a flame emitted by the gas burner, and the control circuit is configured to determine the failure condition in response to the flame detector failing to detect a flame during one of the first and second ignition operations. In some embodiments, the first and second illumination schemes vary from one another based on visual indicator device, color, brightness, pattern, animation, icon, image, video and/or text. In addition, in some embodiments, the gas valve includes an electromechanical gas valve, and the burner control is electronically coupled to the mechanical gas valve through the control circuit to vary the gas flow to the gas burner.

In some embodiments, the control circuit is further configured to adjust a minimum gas flow level for the gas valve in response to detection of a plurality of flame loss incidents. Moreover, in some embodiments, the first and second indications are stored as log information, and the control circuit is further configured to output the log information in response to user input.

Consistent with another aspect of the invention, a cooking appliance may include a gas burner, an igniter disposed adjacent to the gas burner to ignite the gas burner, a gas valve configured to regulate gas flow to the gas burner, a burner control coupled to the gas valve to vary the gas flow to the gas burner, and a control circuit coupled to the igniter and configured to activate the igniter when gas is flowing to the gas burner. The control circuit is further configured to generate a first indication to a user in response to performing an ignition operation, generate a second indication to the user when the gas burner is in a normal operating condition, and generate a third indication to the user when the gas burner has a failure condition, and the first, second and third indications are different from one another to distinguish between the ignition operation, the normal operating condition, and the failure condition.

Also, in some embodiments, the ignition operation is a first ignition operation having an initial ignition type, and the control circuit is further configured to generate a fourth indication to the user in response to performing a second ignition operation having a re-ignition ignition type. In some embodiments, the re-ignition ignition type is a flame loss re-ignition ignition type, and the control circuit is further configured to generate a fifth indication to the user in response to performing a third ignition operation having a program re-ignition ignition type.

Still other embodiments may include methods of operating a cooking appliance incorporating the aforementioned features.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

In the embodiments discussed hereinafter, a gas cooking appliance may generate various indications associated with the state of a gas burner. In some embodiments, for example, a control circuit may be used to generate one or more audible and/or visual indications to a user of a plurality of different gas burner states during the operation of a gas burner, such as states that are associated with different types of ignition operations, such as initial ignition operations, programmed re-ignition operations and/or flame loss re-ignition operations. Further, in some embodiments, a control circuit may be used to generate one or more audible and/or visual indications to a user of a plurality of different gas burner states during the operation of a gas burner, such as states that are associated with at least ignition operations, normal operating conditions, and failure conditions.

Figure 1:
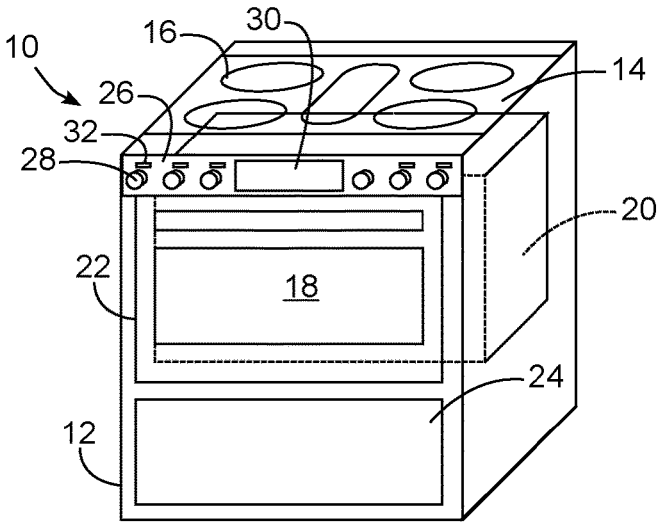
FIG. 1 is a perspective view of a cooking appliance consistent with some embodiments of the invention.

Turning now to the drawings, wherein like numbers denote like parts throughout the several views, FIG. 1 illustrates an example cooking appliance 10 in which the various technologies and techniques described herein may be implemented. Cooking appliance 10 is a residential-type range, and as such includes a housing 12, a stovetop or cooktop 14 including a plurality of burners 16, and an oven 18 defining an oven or cooking cavity 20 accessed via an oven door 22. Cooking appliance 10 may also include a storage drawer 24 in some embodiments, or in other embodiments, may include a second oven. Various cooking elements (not shown in FIG. 1) may also be incorporated into cooking appliance 10 for cooking food in oven 18, e.g., one or more electric or gas heating elements.

Cooking appliance 10 may also include various user interface devices, including, for example, a control panel 26 incorporating a plurality of rotary burner controls 28 and a user interface or display 30 for providing visual feedback as to the activation state of the cooking appliance. In some embodiments, each rotary burner control 28 may include an associated electronic burner control user interface or display 32 that is disposed on or adjacent to a knob or rotary control actuator of the rotary burner control 28, while in other embodiments, no control-specific displays may be used. It will be appreciated that cooking appliance 10 may include various types of user controls in other embodiments, including various combinations of switches, buttons, knobs and/or sliders, typically disposed at the rear or front (or both) of the cooking appliance. Further, in some embodiments, one or more touch screens may be employed for interaction with a user. As such, in some embodiments, display 30 may be touch sensitive to receive user input in addition to displaying status information and/or otherwise interacting with a user. In still other embodiments, cooking appliance 10 may be controllable remotely, e.g., via a smartphone, tablet, personal digital assistant or other networked computing device, e.g., using a web interface or a dedicated app. In some embodiments, both the cooktop burners and the oven may be controlled by the same electronic control system, while in other embodiments, different control systems may be used for separate control of each system.

Each of user interfaces/displays 30, 32 may also vary in different embodiments, and may include various visual indicator devices, including individual indicators, segmented alphanumeric displays, and/or dot matrix displays, and may be based on various types of display technologies, including LEDs, vacuum fluorescent displays, incandescent lights, etc. Further, in some embodiments audio feedback may be provided to a user via one or more audible indicator devices such as speakers, and in some embodiments, user input may be received via a spoken or gesture-based interface.

As noted above, cooking appliance 10 of FIG. 1 is a range, which combines both a stovetop and one or more ovens, and which in some embodiments may be a standalone or drop-in type of range. In other embodiments, however, cooking appliance 10 may be another type of cooking appliance, e.g., a cooktop, stovetop or hob lacking an integrated oven, a wall-mounted oven lacking an integrated cooktop, or an indoor or outdoor grill. In general, a cooking appliance consistent with the invention may be considered to include any residential-type appliance including a housing and one or more cooking elements disposed therein and configured to generate energy for cooking food.

In turn, a cooking element may be considered to include practically any type of energy-producing element used in residential applications in connection with cooking food, e.g., employing various cooking technologies such as electric, gas, light, microwaves, induction, convection, radiation, etc. In the case of an oven, for example, one or more cooking elements therein may be gas, electric, light, or microwave heating elements in some embodiments, while in the case of a cooktop, one or more cooking elements therein may be gas, electric, or inductive heating elements in some embodiments. Further, it will be appreciated that any number of cooking elements may be provided in a cooking appliance (including multiple cooking elements for performing different types of cooking cycles such as baking or broiling), and that multiple types of cooking elements may be combined in some embodiments, e.g., combinations of microwave and light cooking elements in some oven embodiments. In the case of the embodiments discussed hereinafter, at least one of the cooking elements for the cooktop and/or oven includes a gas burner and a mechanical or electromechanical valve unit that couples the gas burner to a gas supply.

Figure 2:
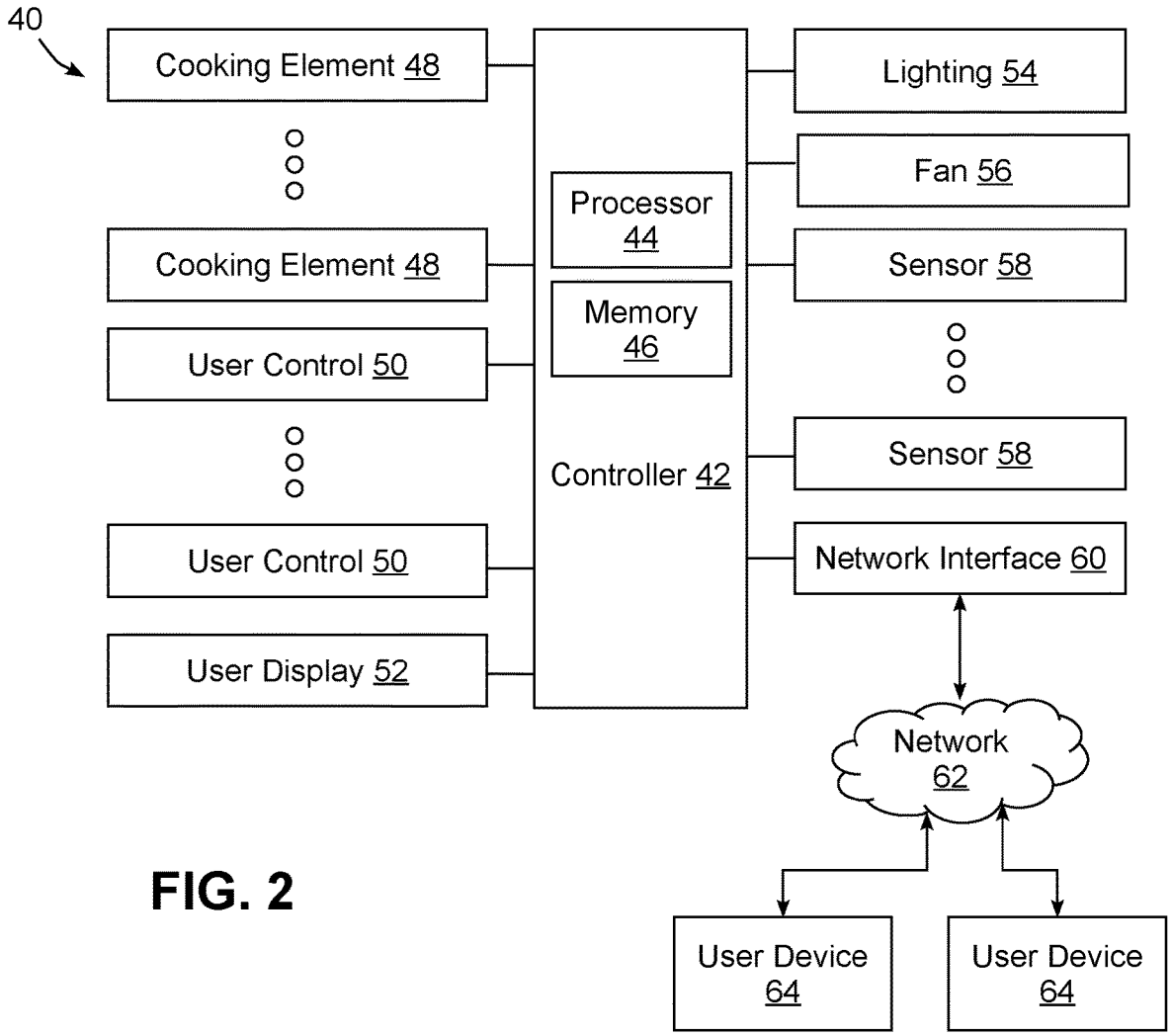
FIG. 2 is a block diagram of an example control system for a cooking appliance consistent with some embodiments of the invention.

A cooking appliance consistent with the invention also generally includes one or more controllers configured to control the cooking elements and otherwise perform cooking operations at the direction of a user. FIG. 2, for example, illustrates an example embodiment of a cooking appliance 40 including a controller 42 that receives inputs from a number of components and drives a number of components in response thereto. Controller 42 may, for example, include one or more processors 44 and a memory 46 within which may be stored program code for execution by the one or more processors. The memory may be embedded in controller 42, but may also be considered to include volatile and/or non-volatile memories, cache memories, flash memories, programmable read-only memories, read-only memories, etc., as well as memory storage physically located elsewhere from controller 42, e.g., in a mass storage device or on a remote computer interfaced with controller 42.

As shown in FIG. 2, controller 42 may be interfaced with various components, including various cooking elements 48 used for cooking food (e.g., various combinations of gas, electric, inductive, light, microwave, light cooking elements, among others), one or more user controls 50 for receiving user input (e.g., various combinations of switches, knobs, buttons, sliders, touchscreens or touch-sensitive displays, microphones or audio input devices, image capture devices, etc.), and a user display 52 (including various indicators, graphical displays, textual displays, speakers, etc.), as well as various additional components suitable for use in a cooking appliance, e.g., lighting 54 and/or one or more fans 56 (e.g., convection fans, cooling fans, etc.), among others. It will be appreciated that for some types of cooking elements and/or controls therefor, e.g., gas cooking elements and controls therefor, the controller may be coupled to various electronic devices associated with the cooking elements and/or controls rather than the cooking elements and/or controls themselves, e.g., igniters, electromechanically-controlled valves, control position sensors, etc.

Controller 42 may also be interfaced with various sensors 58 located to sense environmental conditions inside of and/or external to cooking appliance 40, e.g., one or more temperature sensors, humidity sensors, air quality sensors, smoke sensors, flame sensors, carbon monoxide sensors, odor sensors and/or electronic nose sensors, among others. Such sensors may be internal or external to cooking appliance 40, and may be coupled wirelessly to controller 42 in some embodiments.

In some embodiments, controller 42 may also be coupled to one or more network interfaces 60, e.g., for interfacing with external devices via wired and/or wireless networks such as Ethernet, Wi-Fi, Bluetooth, NFC, cellular and other suitable networks, collectively represented in FIG. 2 at 62. Network 62 may incorporate in some embodiments a home automation network, and various communication protocols may be supported, including various types of home automation communication protocols. In other embodiments, other wireless protocols, e.g., Wi-Fi or Bluetooth, may be used. In some embodiments, cooking appliance 40 may be interfaced with one or more user devices 64 over network 62, e.g., computers, tablets, smart phones, wearable devices, etc., and through which cooking appliance 40 may be controlled and/or cooking appliance 40 may provide user feedback.

In some embodiments, controller 42 may operate under the control of an operating system and may execute or otherwise rely upon various computer software applications, components, programs, objects, modules, data structures, etc. In addition, controller 42 may also incorporate hardware logic to implement some or all of the functionality disclosed herein. Further, in some embodiments, the sequences of operations performed by controller 42 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the cooking appliances illustrated in FIGS. 1-2 will be apparent to one of ordinary skill in the art, as will become apparent from the description below. Therefore, the invention is not limited to the specific implementations discussed herein.

Figure 3:
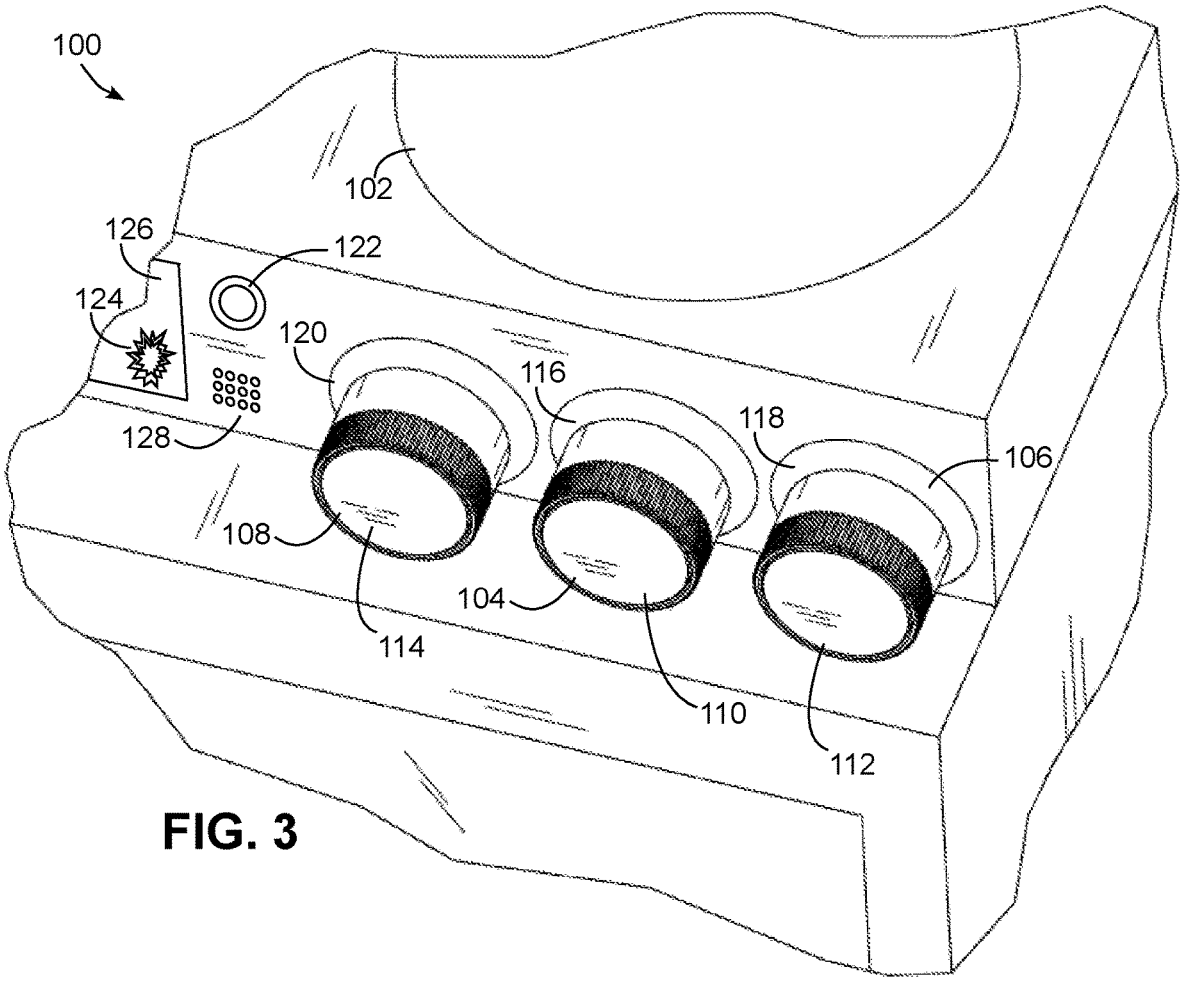
FIG. 3 is a partial perspective view of a cooking appliance implementing rotary burner control of mechanical valve units consistent with some embodiments of the invention.
Figure 4:
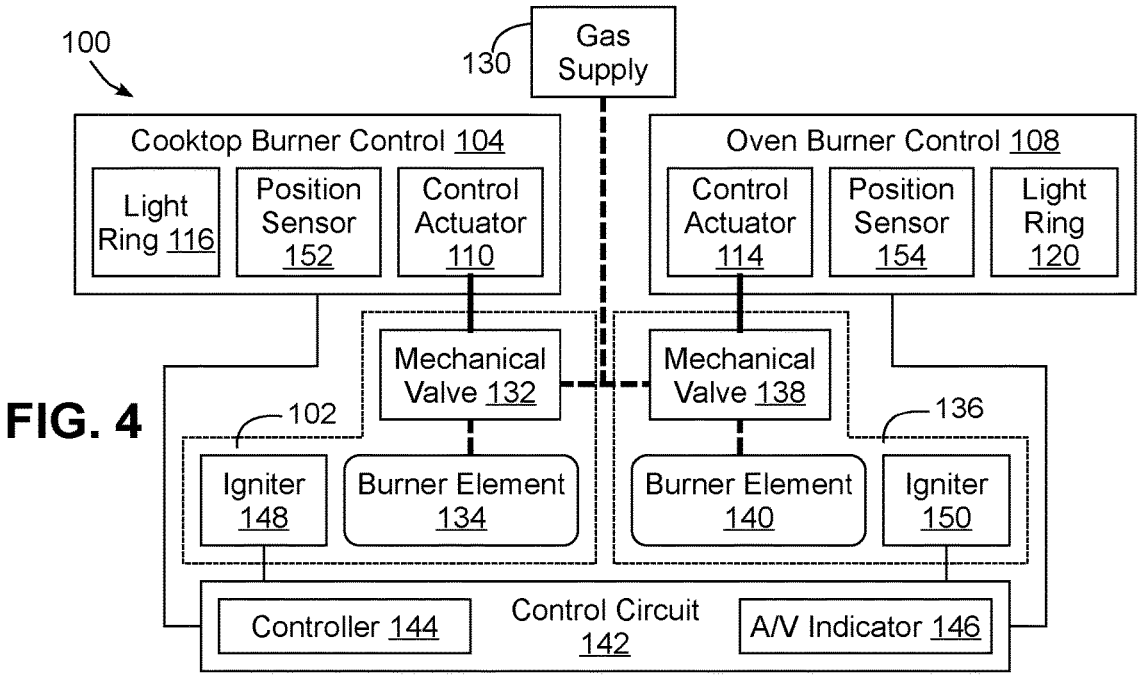
FIG. 4 is a block diagram of an example control system for the cooking appliance of FIG. 3.

As noted above, embodiments consistent with the invention may generate one or more of several different types of indications to a user associated with the state of a gas burner of a gas cooking appliance such as a cooktop, range, grill or oven. In some embodiments, and as illustrated in FIGS. 3-4, a gas burner may be controlled by a mechanical valve that is mechanically coupled to a control actuator such as a knob or slider. FIG. 3, in particular, illustrates a gas range 100 including a gas cooktop burner 102 and a set of burner controls 104, 106, 108, e.g., rotary burner controls, each with a control actuator 110, 112, 114, e.g., a rotary control actuator or knob. In some embodiments, one or more of burner controls 104, 106, 108 may be used to control an oven, rather than a cooktop. In the embodiment discussed below, for example, burner control 104 is used to control gas cooktop burner 102 while burner control 108 is used to control a gas oven burner.

In order to generate indications to a user, gas range 100 may include various types of audible and/or visual indicator devices, e.g., an illuminated light or LED-backlit ring 116, 118, 120 on each burner control 104, 106, 108, a separate, dedicated indicator such as an LED 122 on the control panel, an illuminated icon 124 and/or text displayed on a user interface 126, or a speaker 128 for use in generating audible indications. An indication could also be generated proximate the burner itself, e.g., using a light source positioned close to the burner. Further, an indication could be generated remotely, e.g., by or on an external device located in the proximity of the cooking appliance, e.g., on an overhead range hood or over-the-range microwave oven that is in wired or wireless communication with the cooking appliance. Also, in some instances, the indication may be directed from the other device towards the burner, e.g., using a light source positioned above the burner and capable of illuminating the burner from above to spotlight the burner with which the indication is associated. An indication, in this regard, may be considered to include any type of visual and/or audible presentation to a user that may be recognized by a user, while an indicator device may be considered to include any type of device capable of generating visual and/or audible indications. It will also be appreciated that in some instances, an indication may be generated on a device that is remote from a cooking appliance, e.g., on an interconnected smart home device, mobile device, etc. It will also be appreciated that the various indicator devices 116, 118, 120, 122, 124 and 128 illustrated in FIG. 3 are merely shown on the same gas range 100 for illustrative purposes, and that a cooking appliance consistent with the invention may utilize as few as one such audible and/or visual indicator device in some embodiments. All indications, for example, may be presented on a single indicator device in some embodiments, while in other embodiments, different indicator devices may be used to present different indications.

In addition, it will be appreciated that indications may be generated using indicator devices that may also be used to indicate other status information for a cooking appliance, and that indications in some embodiments may utilize different colors, animations, patterns, sounds, text, graphical images, etc. In one example embodiment, gas burner state-related indications may be implemented by light rings 116, 118, 120, and that additional indications associated with the respective user controls 104, 106, 108 may also be generated using the same light rings 116, 118, 120. For example, a light ring 116, 118, 120 may be used to display various colors or patterns to represent different states, including various ignition operations, re-ignition operations, operational conditions and/or failure conditions of its associated gas burner.

From the perspective of visual indications, for example, various illumination schemes may be associated with different states of a burner, with each illumination scheme being distinguished from the other illumination schemes by one or more of color, brightness, pattern, animation, icon, image, video and/or text, such that a user may readily distinguish between different illumination schemes. Illumination schemes may also be distinguished from one another based upon which visual indicator device(s) is(are) used to represent the state.

With further reference to FIG. 4, gas burner 102 may be coupled to a gas supply 130 through a mechanical valve 132 that regulates the flow of gas to a burner element 134, e.g., via a mechanical coupling to control actuator 110 of cooktop burner control 104. Similar valves and burner elements may be used for the other cooktop burners of appliance 100, but are omitted from FIG. 4 for clarity. In addition, where a gas oven is incorporated into cooking appliance 100, one or more gas oven burners 136, each including an associated mechanical valve 138 and burner element 140, may also be used. As illustrated in FIG. 4, mechanical valve 138 is mechanically coupled to control actuator 114 of oven burner control 108.

Control over cooking appliance 100 may be provided by a control circuit 142, which may include a controller 144 in some embodiments. Control circuit 142 may drive one or more audible and/or visual indicator devices 146 (which may correspond, for example, to any of elements 122, 124 or 128 of FIG. 3) as well as various light rings 116, 120 of burner controls 104, 108. Control circuit 142 may also drive one or more igniters 148, 150, which may be spark, hot surface or other suitable devices for igniting gas, and which, in some embodiments, may also include flame detectors or sensors and/or automatic re-ignition functionality, e.g., using a gas re-igniter module that both ignites a burner on startup and also detects and attempts to re-ignite the burner in response to a flame loss while gas is being supplied to the burner. In other embodiments, however, no automatic re-ignition functionality may be supported.

Further, in some embodiments, each burner control 104, 108 may include an associated position sensor 152, 154 that is used to detect a position of the associated control actuator 110, 114. Each position sensor 152, 154 may be implemented using practically any type of sensor capable of detecting an absolute position and/or relative movement of the rotary control actuator, e.g., an encoder, one or more microswitches, etc. While in some embodiments, a position sensor 152, 154 may have a resolution sufficient to indicate a specific position, in other embodiments a position sensor may only be sufficient to indicate when the control actuator is within a larger range of positions, e.g., in the case of a cam-driven switch that is activated throughout a relatively large range of positions of a control actuator.

Figure 5:
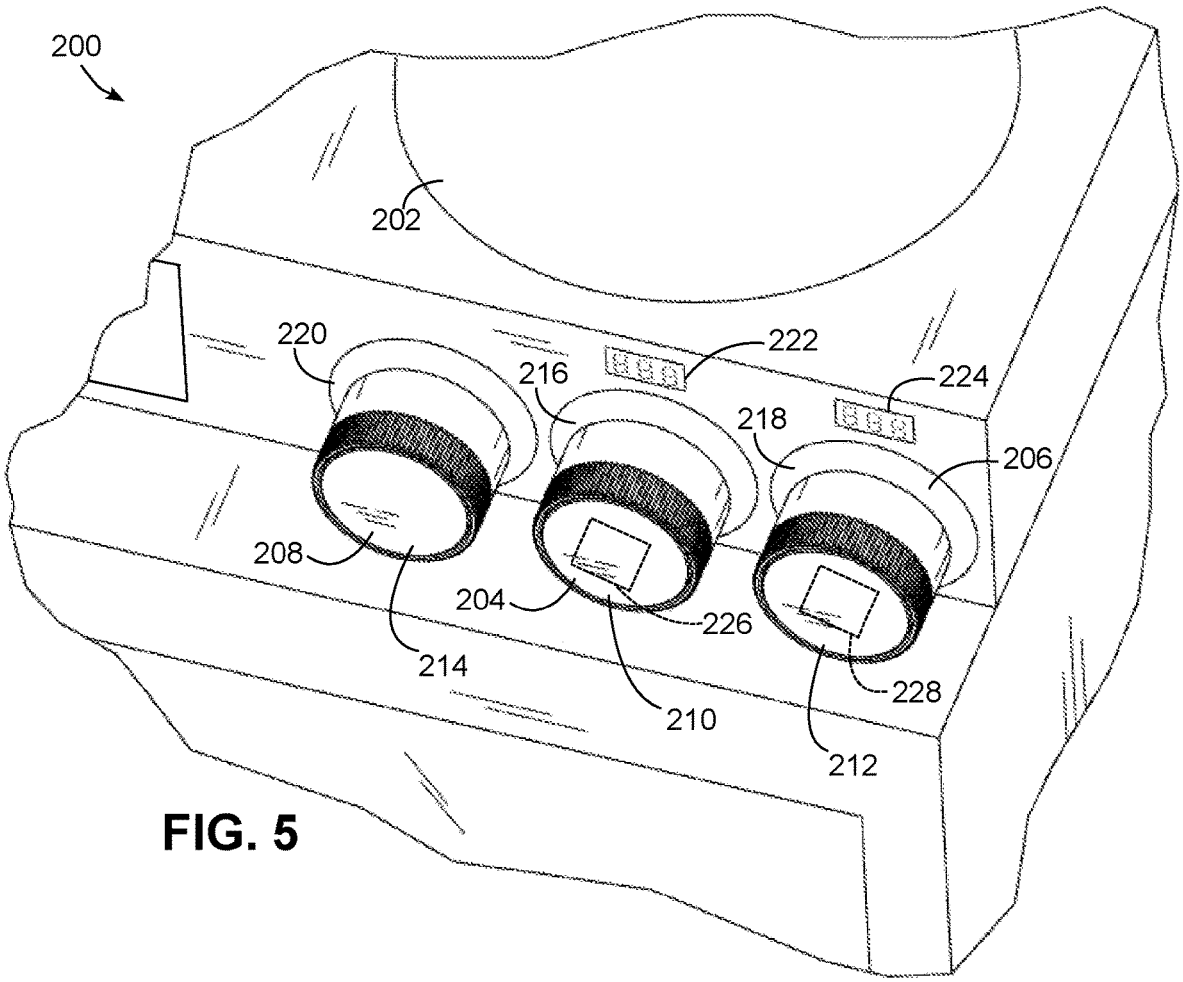
FIG. 5 is a partial perspective view of a cooking appliance implementing rotary burner control of electromechanical valve units consistent with some embodiments of the invention.

As noted above, cooking appliance 100 relies on mechanical gas valves that are mechanically coupled to burner controls. In other embodiments, however, burner controls may be coupled electronically, rather than mechanically, to electromechanical valves for the purpose of controlling a gas burner. FIG. 5, in particular, illustrates a cooking appliance 200 including a gas cooktop burner 202 and several burner controls 204, 206, 208, each with an associated control actuator 210, 212, 214 and light ring 216, 218, 220. In this embodiment, burner controls 204, 206 are used for cooktop burners and include associated user interfaces or displays 222, 224, while burner control 208 is used for an oven burner. Furthermore, at least burner controls 204, 206 include associated secondary controls 226, 228, which may be implemented as switches or touch sensors configured to detect an axial force applied to the associated control actuator 210, 212 and generate an actuation signal in response thereto, e.g., for turning a gas burner on or off or performing other user inputs, as will be discussed in greater detail below.

Figure 6:
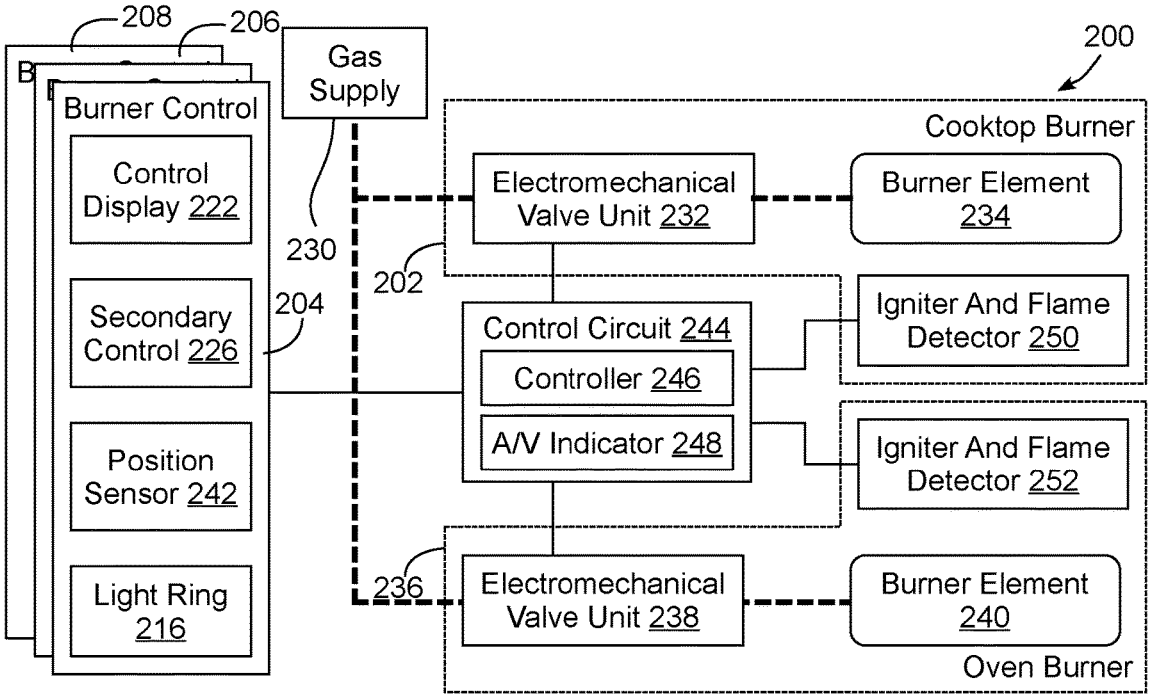
FIG. 6 is a block diagram of an example control system for the cooking appliance of FIG. 5.

With further reference to FIG. 6, gas burner 202 may be coupled to a gas supply 230 through an electromechanical valve 232 that regulates the flow of gas to a burner element 234. Similar valves and burner elements may be used for the other cooktop burners of appliance 200, but are omitted from FIG. 4 for clarity. In addition, where a gas oven is incorporated into cooking appliance 200, one or more gas oven burners 236, each including an associated electromechanical valve unit 238 and burner element 240, may also be used. An electromechanical valve unit, in this regard, may include any number of different valves and/or valve combinations that regulated the flow of gas to a gas burner in response to electronic control, e.g., an on/off or proportional valve controlled by a stepper motor, an electrically-controlled proportional valve (e.g., a normally-closed current controlled proportional valve), a parallel arrangement of discrete on/off valves having differing flow rates, or other valve designs and/or combinations of valves as will be appreciated by those of ordinary skill having the benefit of the instant disclosure.

Each burner control, e.g., burner control 110, generally includes, in addition to a control actuator, an electronic burner control user interface or display 222, light ring 216, and secondary control 226. In addition, each burner control may also include a position sensor 242, which in the illustrated embodiment is implemented as an encoder such as an A-quad-B encoder, but could also be implemented using other encoders or switches. In some embodiments, each burner control may be a rotary burner control, and may include a rotary control actuator such as a knob, ring or wheel. In the illustrated embodiment, the rotatable knob may be a continuous rotatable knob that is infinitely rotatable in both directions, while in other embodiments the knob may be rotatable only within a limited range.

An electronic burner control user interface or display may also be implemented in a number of manners in different embodiments. In the illustrated embodiment, for example, each electronic burner control user interface or display may be implemented using a multi-segment, multi-digit LED display. In other embodiments, however, such a user interface or display may be positioned in other locations adjacent the rotary control actuator, or even on the rotary control actuator itself. In some embodiments, e.g., where a rotary control actuator is a ring or wheel, such a user interface or display may be positioned on a stationary front or side surface proximate or on the rotary control actuator. In addition, the user interface or display is generally dedicated to a particular burner and rotary burner control such that the user interface or display only displays status information related to that burner and rotary burner control, e.g., a current output power level of the burner (e.g., a numerical value or label such as 0-10, a percent, a descriptor such as "low," "medium," or "high,", etc.). In other embodiments, however, other user interface technologies may be used, e.g., using dot-matrix panels, LED or LCD panels, vacuum fluorescent displays, discrete illumination sources, etc. Furthermore, user interfaces or displays may support multiple burners and rotary burner controls in some embodiments, e.g., to display status information for multiple burners having closely-positioned rotary burner controls. In still other embodiments, a single user interface or display may be used for all gas and/or cooktop burners.

Each light ring 216 may be implemented using one or more LED indicators that illuminate various portions of the burner control, and that in some embodiments may also convey additional status information, e.g., a rotary position indicator, a color or animation representing on/off status, hot burner status, and other burner state-related indications as discussed herein. In other embodiments, no illumination may be supported, so backlit ring 216 may be omitted. It will also be appreciated that any of the various types of indicator devices discussed above in connection with cooking appliance 100 may also be used in connection with cooking appliance 200 in other embodiments, as well as that the aforementioned indicator devices may be used in connection with burner state-related indications in different embodiments.

Each secondary control 226 may be used to provide a secondary source of user input to supplement the rotational input received via rotation of the control actuator, e.g., to activate or deactivate the gas burner, to ignite the gas burner, or provide other user input. The secondary control 226 may be implemented using a touch sensor, a mechanical or magnetic switch on rotary control actuator, a mechanical or magnetic switch capable sensing axial movement of the control actuator itself, or any other sensor capable of sensing an axial force applied generally along the axis of rotation of the rotary control actuator. In other embodiments, a secondary control may be implemented separately from a control actuator (e.g., adjacent thereto on the control panel) or may be omitted entirely.

Each position sensor 242 may be implemented using practically any type of sensor capable of detecting an absolute position and/or relative movement of the rotary control actuator, e.g., an encoder, one or more microswitches, etc. In one embodiment, an A-quad-B encoder may be used to indicate both a direction and extent of relative rotation of the rotary control actuator.

Control over appliance 200 may be provided by a control circuit 244, which in some embodiments may include a controller 246 and one or more audible and/or visual indicator devices 248, and which may control ignition of burners 202, 236 using igniters and flame detectors 250, 252, e.g., implementing automatic re-ignition functionality. Controller 246 in the illustrated embodiment may be used to execute instructions that implement software-based control over appliance 200; however, it will be appreciated that various aspects of the invention described herein may be implemented in control circuits lacking any controllers or other software-based functionality, so the invention is not limited to software-based controls and the like.

Gas Burner State Indications

It may be desirable in some embodiments to indicate multiple different gas burner states for a gas burner to provide a user, or in some instances, a technician user, with status information regarding a gas burner. In particular, it may be desirable to utilize different visual and/or audible indications on a gas cooking appliance to indicate various status of various gas burners of the appliance.

In some instances, the different states may include states associated with different types of ignition operations to enable indications to indicate to a user which among the different types of ignition operations are being performed at any given time. For example, in appliances with automatic ignition systems, it may be desirable to distinguish between initial ignition operations (also referred to herein as operations having an initial ignition type), which are ignition operations performed when initially turning on a gas burner, from re-ignition operations (i.e., operations having a re-ignition ignition type), which are ignition operations performed after a gas burner has already been in use, and has temporarily been turned off or has otherwise experienced a flame loss during its use.

In some instances, for example, a cooking appliance may support a simmer or low output mode and/or may support programmable cooking profiles that cycle a gas burner on and off during a cooking operation. Thus, while a gas burner is in its normal operating condition, the gas burner may periodically be turned off (e.g., by closing a gas valve) and then re-ignited. Such a re-ignition operation is referred to herein as a program re-ignition operation (i.e., an operation having a program re-ignition ignition type) insofar as the operation is performed as part of a program executed by the cooking appliance.

In other instances, a cooking appliance may monitor a gas burner for flame loss, e.g., due to poor combustion or performance of the gas burner, a poor operating environment for the gas burner such as a drafty environment, etc., and in response to detecting a flame loss, attempt a re-ignition operation to restart the gas burner. Such a re-ignition operation is referred to herein as a flame loss re-ignition operation (i.e., an operation having a flame loss re-ignition ignition type) insofar as the operation is performed as a result of detecting a flame loss, e.g., with a flame detector.

It may be desirable in various embodiments to generate different indications to a user in order to distinguish between some or all of the aforementioned types of ignition operation, thereby enabling a user to recognize that (1) an ignition operation is being performed and (2) what type of ignition operation is being performed, which can also indicate, in some instances, a potential issue of concern (e.g., a re-ignition due to an unexpected flame loss rather than an intended, preplanned or expected ignition or re-ignition).

Of note, these ignition-related indications may also differ in some embodiments from indications that indicate other gas burner states, e.g., burner off states, burner on states, or states associated with various failure conditions. In some embodiments, for example, it may be desirable to define at least three states for which distinct indications are defined, including one or more states associated with an ignition operation, one or more states associated with a normal operating condition, and one or more states associated with one or more failure conditions. As noted above, in some embodiments, it may also be desirable to define different states for different types of ignition operations, although in other embodiments a single state may be used to represent multiple types of ignition operations. A normal operating condition may be considered to represent the ordinary and expected operation of a gas burner, i.e., a condition in which gas is flowing to the gas burner and being combusted to generate a flame and heat.

A failure condition, in contrast, may represent a condition in which the gas burner has experienced a failure, and thus is not operating in an ordinary and expected manner. In some instances, a failure condition may be associated with a flame loss. The flame loss, moreover, may be associated with a condition in which a gas valve is still open and gas is still being emitted by the gas burner, as may be the case where the gas burner is controlled by a manual gas valve. In other embodiments, however, a failure condition may be associated with a flame loss that is accompanied by a shut off of the gas burner such that any gas flow to the gas burner has been shut off, e.g., as may be the case in a cooking appliance that incorporates electromechanical gas valves and/or master valves that are capable of being electronically shut off in response to the detection of a flame loss. Moreover, while in some instances detection of a flame loss alone may be used to indicate a failure condition, in other instances a failure condition may be indicated only when a flame loss is accompanied by one or more failed attempts to re-ignite the gas burner after the flame loss is detected.

Other failure conditions that may be associated with a gas burner state in other embodiments may include various conditions where a flame is detected unexpectedly and/or where an expected flame is not detected. For example, one such condition may occur when a gas burner is commanded to be turned off or otherwise expected to be off, yet a flame is detected, e.g., during a program off period such as described below in connection with FIG. 7, or in the case of the completion of a timed cooking sequence, where a valve potentially sticks or otherwise fails to turn off. Another such condition may occur with a manual gas valve, e.g., when a position sensor detects that the valve is in an off position but a flame is still detected. Still another such condition may occur where one gas burner is commanded to be ignited but an unexpected flame state change is detected with a different gas burner that has ignited either simultaneously with or instead of the expected gas burner (which could occur, for example, due to a wiring or software issue).

In addition, as will be discussed in greater detail below, gas burner states, and indications related thereto, may be stored as log information in some embodiments for later retrieval and/or presentation to a user, e.g., a consumer or a technician. It may be desirable for troubleshooting purposes, for example, to enable failure conditions, ignition operations and/or other activities associated with a gas burner to be logged, as a log may be used to identify failures and/or the reasons for various ignition operations being performed. In some embodiments, for example, repeated unintended flame loss incidents may be used to trigger a recalibration operation in some embodiments to adjust a minimum gas flow to a higher, more stable value.

In one example implementation discussed hereinafter, for example, a digital gas cooking appliance, e.g., gas range 200 of FIGS. 5-6, may include a gas burner 202, an igniter and flame detector 250 disposed adjacent to the gas burner to ignite the gas burner as well as sense a flame emitted by the gas burner, an electromechanical gas valve unit 232 configured to regulate gas flow to the gas burner, a burner control 206 electronically coupled to the gas valve to vary the gas flow to the gas burner, e.g., having a rotary control knob or actuator, and a visual indicator device (light ring 216) positioned proximate the burner control. A control circuit 244 may be used to control the electromechanical valve to regulate gas flow to the gas burner, activate the igniter when gas is flowing to the gas burner, and detect a flame loss using the flame detector.

Further, the control circuit may be used to distinguish between six different states of the gas burner, and to control light ring 216 to generate six distinct indications to represent these different states to a user. While other illumination schemes may be used in other embodiments, in this particular embodiment different colors may be used to represent different states. For example, in some embodiments, the light ring may be controlled to "pulse", "breathe," "blink", "chase" or otherwise move around the control knob, among other alternatives. The states and associated illumination schemes are illustrated below in Table I:

TABLE I

| Gas Burner States | | |
|---|---|---|
| State | Description | Color |
| 1 | Burner Off | None (LEDs off) |
| 2 | Ignition | White |
| 3 | Burner On | Light Blue |
| 4 | Program Re-Ignition | Dark Blue |
| 5 | Flame Loss Re-Ignition | Orange |
| 6 | Failure | Red |

Figure 7:
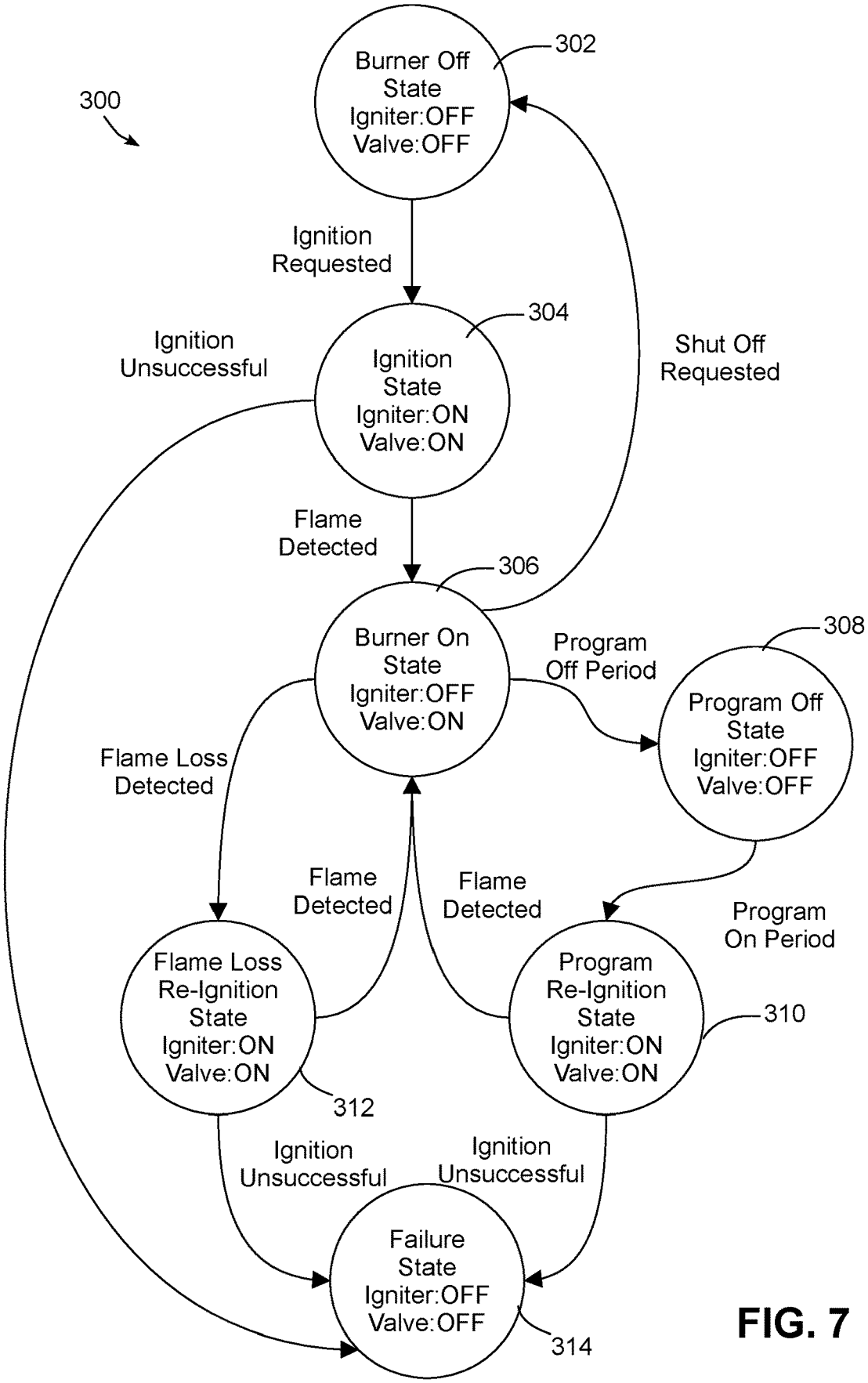
FIG. 7 is a state diagram for an example gas burner control circuit consistent with some embodiments of the invention.

FIG. 7, for example, illustrates a state diagram 300 representing the aforementioned states. Starting in a burner off state 302, both the igniter and valve for the burner are off, and an illumination scheme associated with this state may be displayed, e.g., with all LEDs in the light ring turned off. Upon receipt of an ignition request (e.g., triggered via interaction with a burner control and/or a secondary control, such as turning a control knob and touching a touch sensor), a transition may occur to an ignition state 304, at which point the igniter is turned on and the gas valve is opened (i.e., turned on) to an appropriate position to supply a sufficient flow of gas to ignite the burner. The illumination scheme for this state, here a white color for the light ring, may be displayed.

Once a flame has been detected by the flame detector, a transition may occur to a burner on state 306, representing a normal operating condition for the gas burner. At this time, the igniter may be turned off, and the gas valve may be controlled by the user to provide a desired output level (e.g., by turning a control knob), or if a programmed cooking profile is being used, the gas valve may be set to a programmed position. The illumination scheme for this state, here a light blue color, may be displayed.

As noted above, in some embodiments simmer or low power modes may be supported and/or cooking profiles may be supported, such that, at one or more points in a cooking operation, the gas burner may be intentionally and temporarily turned off and later re-ignited using a program re-ignition operation. In this regard, a gas burner may be operated to alternate between different program on and program off periods. As such, at any point in which it is desired to turn off the gas burner (a program off period), a transition may occur to a program off state 308, at which point the igniter may remain off and the gas valve may be closed or shut off to extinguish the gas burner. At this point, it may be desirable to utilize a different illumination scheme, e.g., by turning off the light ring or using an illumination scheme that is different from any of the illumination schemes represented in Table I, although in the illustrated embodiment it may be desirable to maintain the same illumination scheme as the burner on state 306 (i.e., a light blue color) so that the user recognizes that the burner is still "on" and operating normally despite the fact that the burner is temporarily shut off.

Then, once it is time to re-ignite the gas burner after temporarily shutting off the gas burner (i.e., transitioning from a program off period to a program on period), a transition may occur to a program re-ignition state 310, at which point the igniter is turned on and the gas valve is opened (i.e., turned on) to an appropriate position to supply a sufficient flow of gas to ignite the burner. The illumination scheme for this state, here a dark blue color for the light ring, may be displayed.

Once a flame has been detected by the flame detector, a transition may then occur back to burner on state 306, at which point the igniter may be turned off, and the gas valve set to a user-selected or programmed position to provide a desired output level. The illumination scheme may then return to the light blue color.

Also, if at any point during the normal operation of the gas burner, a flame loss is detected by the flame detector, a transition may occur from state 306 to a flame loss re-ignition state 312 to attempt to re-ignite the gas burner. At this point, the igniter may be turned on and the gas valve set to an appropriate position to supply a sufficient flow of gas to ignite the burner. The illumination scheme for this state, here an orange color for the light ring, may be displayed to indicate that the re-ignition is being attempted, and if a flame is subsequently detected, a transition may occur back to burner on state 306, with the illumination scheme returned to a light blue color, the igniter turned off, and the gas valve returned to its last position.

As represented by the arrows from states 304, 310 and 312, if at any time the ignition operation performed by the respective state is unsuccessful (e.g., based upon a failure to detect a flame after a sufficient duration and/or after a sufficient number of attempts), control may pass to a failure state 314, where both the igniter and gas valve are turned off and the gas burner is effectively shut off. The illumination scheme for this state, here a red color for the light ring, may be displayed to indicate that the gas burner has the failure condition. Thus, despite the fact that the gas burner is off, it may be desirable to continue to display the illumination scheme for the failure condition to notify the user of the failure condition.

It will also be appreciated that at any time, a shut off of the gas burner may be requested (e.g., using a burner control, secondary control, or other suitable control). Such an operation is represented by the arrow from burner on state 306 to burner off state 302.

Figure 8:
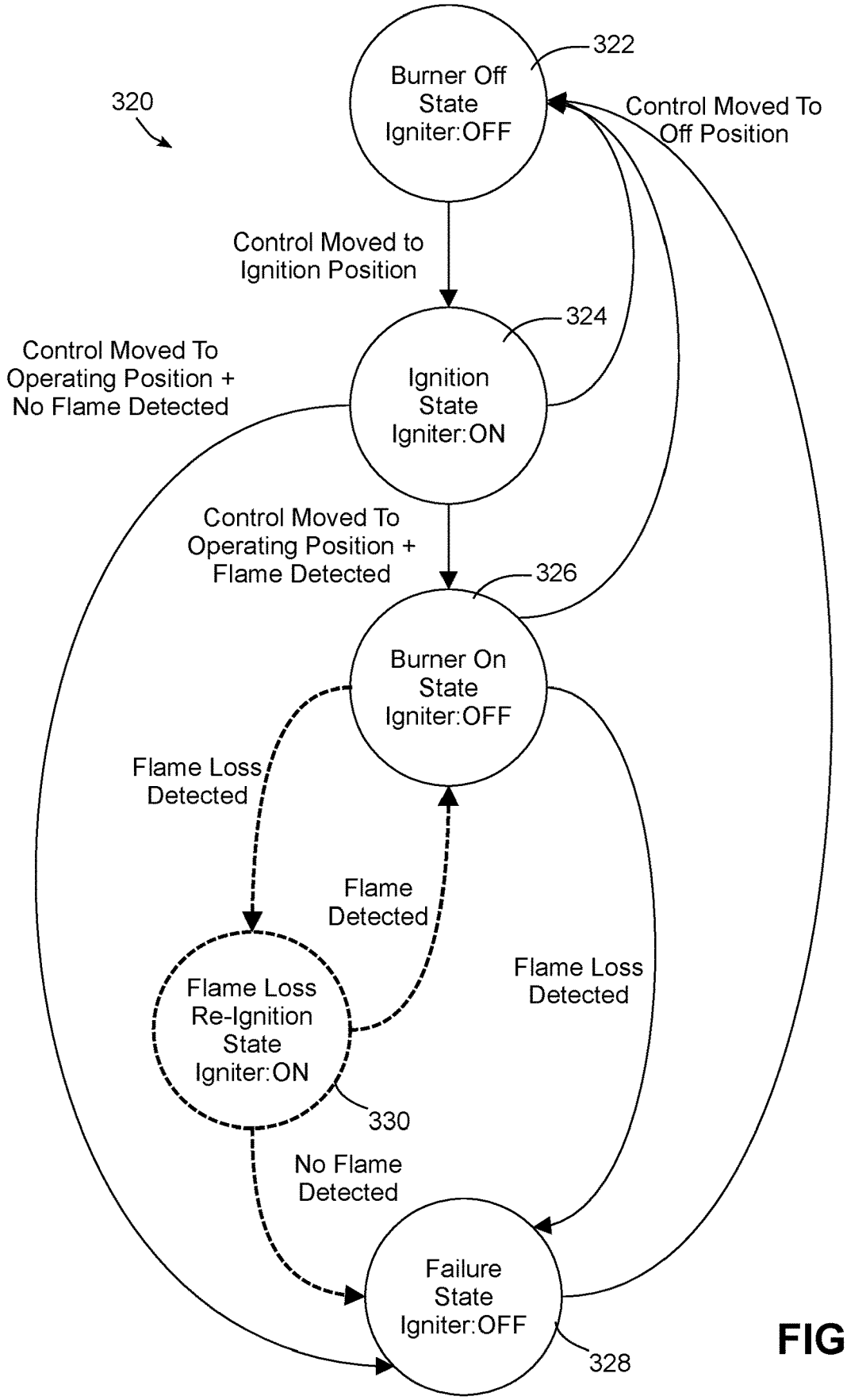
FIG. 8 is a state diagram for another example gas burner control circuit consistent with some embodiments of the invention.

Now turning to FIG. 8, another state diagram 320, suitable for example for use with a manual gas system such as described above in connection with gas range 100 of FIGS. 3-4, is illustrated. In this embodiment, the gas valve for a gas burner is controlled manually and mechanically, so state transitions may be based at least in part on a position sensor for a burner control, as well as a flame sensor. A position sensor may discriminate, for example, between three ranges of positions for the gas valve: (1) burner off (e.g., about 0 to about 20 degrees), (2) ignition (e.g., about 20 to about 90 degrees), and (3) operating (e.g., about 90 to about 270 degrees). In addition, in some embodiments, the igniter may be controlled to always be active when the burner control is in an ignition position, while in other embodiments (e.g., those with automatic re-ignition) control over the igniter may be independent from the burner control position. From the inputs of the position sensor and the flame detector, at least states 1-3 and 6 of Table I may be supported. Furthermore, if automatic re-ignition is supported (using a suitable igniter device), state 5 may also be supported. In general, in embodiments where no electronic control over a gas valve is supported, state 4 would generally not be applicable.

Starting in a burner off state 322, the igniter is off and the valve is closed, and an illumination scheme associated with this state may be displayed, e.g., with all LEDs in the light ring turned off. Upon sensing the burner control moving to an ignition position with the position sensor, a transition may occur to an ignition state 324, at which point the igniter is turned on (i.e., turned on). The illumination scheme for this state, here a white color for the light ring, may be displayed.

Once the burner control is moved to an operating position and a flame has been detected by the flame detector, a transition may occur to a burner on state 326, representing a normal operating condition for the gas burner. At this time, the igniter is off or is turned off, and the gas valve may be controlled by the user to provide a desired output level. The illumination scheme for this state, here a light blue color, may be displayed.

As noted above, in some embodiments, no automatic re-ignition may be supported, and as such, if a flame loss is detected at any time when in the burner on state 326, a transition may occur to a failure state 328, and an illumination scheme for this state, here a red color, may be displayed. In addition, since no electronic control over the gas valve is supported in this embodiment, gas may continue to flow to the gas burner, so it may also be desirable to utilize an indication that is more pronounced, e.g., by incorporating an audible indication to notify or alert a user that the gas burner has lost its flame but is still emitting gas. In other embodiments, e.g., embodiments incorporating an electronically-controllable master valve, support for an automatic gas shut off after a predetermined delay may also be supported.

In other embodiments, however, automatic re-ignition may be supported, so as illustrated by flame loss re-ignition state 330, detection of a flame loss in burner on state 326 may alternately transition to flame loss re-ignition state 330 rather than failure state 328 to attempt to re-ignite the gas burner. At this point, the igniter may be turned on, and the illumination scheme for this state, here an orange color for the light ring, may be displayed to indicate that the re-ignition is being attempted. If a flame is subsequently detected, a transition may occur back to burner on state 326, with the illumination scheme returned to a light blue color, and the igniter may be turned off. However, if no flame is detected (e.g., within a predetermined duration), control may pass to failure state 328 to notify the user that the burner is still emitting gas but no combustion is occurring.

Returning to ignition state 324, a similar operation may occur if no flame is detected within a predetermined duration, resulting in a transition to failure state 328 to alert the user. Moreover, it will be appreciated that at any time that the burner control is returned to an off position a transition may occur back to burner off state 322.

Figure 9:
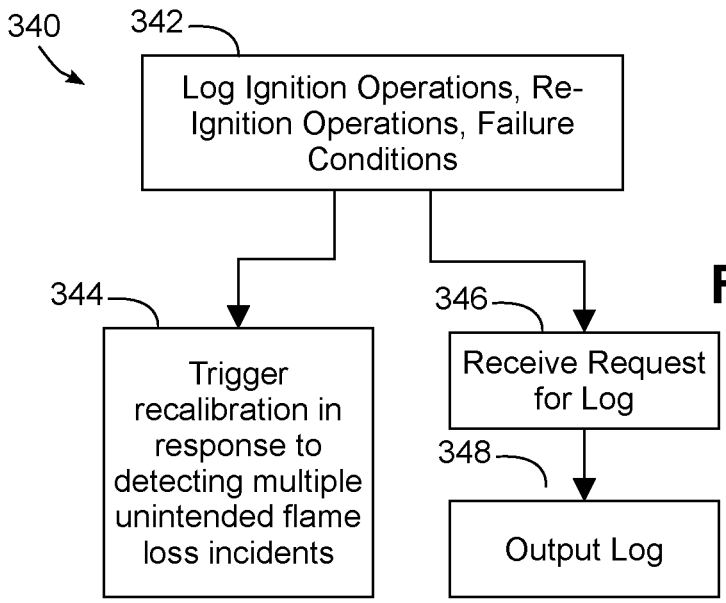
FIG. 9 is a flowchart illustrating an example sequence of operations for logging state information consistent with some embodiments of the invention.

Now turning to FIG. 9, as noted above, in some embodiments indications associated with various burner states may not be presented immediately to a user, but may be stored and presented at a later point in time and/or used for additional purposes, e.g., for diagnostic or troubleshooting reasons. FIG. 9, in particular, illustrates a sequence of operations 340 for logging state information about a gas burner. In block 342, in particular, various ignition operations, including re-ignition operations and/or failure conditions, may be logged during normal use of the gas burner. The logging may include storing the information in a memory of a cooking appliance, or in some embodiments on a remote device such as a cloud service. The logging information may identify, for example, information such as a number of ignition operations, a type of each ignition operation, any detected failure conditions, etc., as well as other suitable information such as how long the burner was active, the output levels of the gas valve, etc. In some embodiments, error codes may be assigned to various failure conditions and/or ignition operations.

As illustrated in block 344, in some embodiments it may be desirable to use logged information to trigger recalibration of a gas burner. For example, if repeated unintended flame losses are detected, it may be desirable to recalibrate a minimum gas flow level for the gas burner, or to simply increase the minimum gas flow level, to reduce the likelihood of future flame loss incidents. It may be the case, for example, that the gas supply pressure for a particular cooking appliance is lower than average, or the cooking appliance is installed in a particularly drafting location, such that an increase in the minimum gas flow level will reduce future flame loss incidents.

As illustrated in blocks 346 and 348, it may also be desirable in some embodiments to output log information on demand, e.g., upon request by a consumer, a technician or other user. Such information may be displayed on a display of the cooking appliance, or communicated to, processed by and/or displayed on a remote device in communication with the cooking appliance.

As noted above, embodiments consistent with invention may support different combinations of burner states, different indication types and indicator devices, and functionality other than that described herein. Further, while the illustrated embodiments focus on a cooktop gas burner, it will be appreciated that the same principles may apply to other types of gas burners, including oven burners, grill burners, etc. Other modifications may be made to the embodiments discussed herein, and a number of the concepts disclosed herein may be used in combination with one another or may be used separately. Therefore, the invention lies in the claims hereinafter appended.

What is claimed is:

1. A cooking appliance, comprising:

a cooktop including a gas burner;

an igniter disposed adjacent to the gas burner to ignite the gas burner;

a flame detector positioned to sense a flame emitted by the gas burner;

an electromechanical gas valve configured to regulate gas flow to the gas burner;

a burner control electronically coupled to the gas valve to vary the gas flow to the gas burner;

a visual indicator device positioned proximate the burner control; and a control circuit coupled to the indicator, the igniter, the electromechanical gas valve and the flame detector and configured to control the electromechanical valve to regulate gas flow to the gas burner and activate the igniter when gas is flowing to the gas burner, the control circuit further configured to detect a flame loss using the flame detector and control the visual indicator device to distinguish between first, second, third, fourth, and fifth states of the gas burner;

wherein when the gas burner is in the first state, the control circuit controls the visual indicator device to generate a first indication to indicate that the gas burner is performing an initial ignition operation;

wherein when the gas burner is in the second state, the control circuit controls the visual indicator device to generate a second indication to indicate that the gas burner is in a normal operating condition;

wherein when the gas burner is in the third state, the control circuit controls the visual indicator device to generate a third indication to indicate that the gas burner is performing a flame loss re-ignition operation;

wherein when the gas burner is in the fourth state, the control circuit controls the visual indicator device to generate a fourth indication to indicate that the gas burner is performing a program re-ignition operation;

wherein when the gas burner is in the fifth state, the control circuit controls the visual indicator device to generate a fifth indication to indicate that the gas burner has a failure condition due to an inability to ignite the gas burner after attempting an initial ignition, flame loss re-ignition or program re-ignition operation; and wherein the first, third, and fourth indications are different from one another to distinguish between the initial ignition operation, the flame loss re-ignition operation, and the program re-ignition operation.

2. A cooking appliance, comprising:

a gas burner;

an igniter disposed adjacent to the gas burner to ignite the gas burner;

a gas valve configured to regulate gas flow to the gas burner;

a burner control coupled to the gas valve to vary the gas flow to the gas burner; and a control circuit coupled to the igniter and configured to activate the igniter when gas is flowing to the gas burner, and the control circuit further configured to generate a first indication to a user in response to performing a first ignition operation of a first ignition type and to generate a second indication to the user in response to performing a second ignition operation of a second ignition type, wherein the first and second indications are different from one another to distinguish between the first and second ignition types.

3. The cooking appliance of claim 2, wherein the first ignition type is an initial ignition type and the second ignition type is a re-ignition ignition type.

4. The cooking appliance of claim 3, wherein the second ignition type is a flame loss re-ignition ignition type, and wherein the control circuit is further configured to generate a third indication to the user in response to performing a third ignition operation of a third ignition type, wherein the third ignition type is a program re-ignition ignition type.

5. The cooking appliance of claim 2, wherein the first ignition type is a flame loss re-ignition ignition type and the second ignition type is a program re-ignition ignition type.

6. The cooking appliance of claim 2, wherein the control circuit is configured to generate each of the first and second indications by generating audible indications.

7. The cooking appliance of claim 2, wherein the control circuit is configured to generate each of the first and second indications by generating visual indications.

8. The cooking appliance of claim 7, wherein the burner control comprises a rotary control actuator and a visual indicator device, and wherein the control circuit is configured to generate each of the first and second indications using the visual indicator device.

9. The cooking appliance of claim 8, wherein the visual indicator device is a light ring that circumscribes the rotary control actuator.

10. The cooking appliance of claim 8, wherein the control circuit is configured to generate the first indication by illuminating the visual indicator device with a first illumination scheme, and to generate the second indication by illuminating the visual indicator device with a second illumination scheme.

11. The cooking appliance of claim 10, wherein the control circuit is further configured to illuminate the visual indicator device with a third illumination scheme when the burner is in a normal operating condition.

12. The cooking appliance of claim 11, wherein the control circuit is further configured to illuminate the visual indicator device with a fourth illumination scheme when the gas burner has a failure condition.

13. The cooking appliance of claim 12, further comprising a flame detector positioned to sense a flame emitted by the gas burner, wherein the control circuit is configured to determine the failure condition in response to the flame detector failing to detect a flame during one of the first and second ignition operations.

14. The cooking appliance of claim 10, wherein the first and second illumination schemes vary from one another based on visual indicator device, color, brightness, pattern, animation, icon, image, video and/or text.

15. The cooking appliance of claim 2, wherein the gas valve comprises an electromechanical gas valve, and the burner control is electronically coupled to the mechanical gas valve through the control circuit to vary the gas flow to the gas burner.

16. The cooking appliance of claim 2, wherein the control circuit is further configured to adjust a minimum gas flow level for the gas valve in response to detection of a plurality of flame loss incidents.

17. The cooking appliance of claim 2, wherein the first and second indications are stored as log information, and the control circuit is further configured to output the log information in response to user input.

18. A cooking appliance, comprising:

a gas burner;

an igniter disposed adjacent to the gas burner to ignite the gas burner;

a gas valve configured to regulate gas flow to the gas burner;

a burner control coupled to the gas valve to vary the gas flow to the gas burner; and a control circuit coupled to the igniter and configured to activate the igniter when gas is flowing to the gas burner, and the control circuit further configured to generate a first indication to a user in response to performing a first type of ignition operation, generate a second indication to the user when the gas burner is in a normal operating condition, generate a third indication to the user when the gas burner has a failure condition, and generate a fourth indication to the user in response to performing a second type of ignition operation, wherein the first, second, third, and fourth indications are different from one another to distinguish between the first type of ignition operation, the normal operating condition, the failure condition, and the second type of ignition operation.

19. The cooking appliance of claim 18, wherein the first type of ignition is having an initial ignition type and the second type of ignition is a re-ignition ignition type.

20. The cooking appliance of claim 19, wherein the re-ignition ignition type is a flame loss re-ignition ignition type or a program re-ignition ignition type.

* * * * *